United States Patent [19]

Sadahiro

[11] Patent Number: 4,947,599

[45] Date of Patent: Aug. 14, 1990

[54] TRUSSED GIRDER WITH PRE-TENSION MEMBER THEREIN

[75] Inventor: Osamu Sadahiro, Tokyo, Japan

[73] Assignee: Shimizu Construction Co., Ltd., Tokyo, Japan

[21] Appl. No.: 356,441

[22] Filed: May 24, 1989

[30] Foreign Application Priority Data

May 26, 1988 [JP] Japan ..... 63-129221

[51] Int. Cl.[5] ..... E04B 1/24; E04C 3/10

[52] U.S. Cl. ..... 52/226; 52/223 R; 52/745

[58] Field of Search ..... 52/223 R, 225, 226, 52/86, 87, 693, 641, 644, 745

[56] References Cited

U.S. PATENT DOCUMENTS

| | | | |
|---|---|---|---|
| 3,140,764 | 7/1964 | Cheskin | 52/223 R |
| 3,251,162 | 5/1966 | Strimple | 52/223 R |
| 3,257,764 | 6/1966 | Cripe | 52/223 R X |
| 3,385,015 | 5/1968 | Hadley | 52/223 R |
| 3,964,217 | 6/1976 | Leone | 52/86 |
| 4,144,686 | 3/1979 | Gold | 52/223 R |
| 4,223,495 | 9/1980 | Peter | 52/223 R |
| 4,470,233 | 9/1984 | Murakami et al. | 52/223 R |
| 4,607,470 | 8/1986 | Ecker . | |
| 4,620,400 | 11/1986 | Richard | 52/223 R X |
| 4,641,477 | 2/1987 | Schleck | 52/86 X |
| 4,697,397 | 10/1987 | Okuda et al. | 52/223 R |

FOREIGN PATENT DOCUMENTS

| | | | |
|---|---|---|---|
| 1350599 | 4/1964 | France | 52/223 R |
| 62-37449 | 2/1987 | Japan . | |
| 968251 | 10/1982 | U.S.S.R. | 52/223 R |
| 588208 | 2/1945 | United Kingdom . | |
| 8303859 | 4/1983 | World Int. Prop. O. . | |

*Primary Examiner*—Richard E. Chilcot, Jr.
*Attorney, Agent, or Firm*—Darby & Darby

[57] ABSTRACT

A trussed girder to be positioned between a pair of columns, the trussed girder comprising:

a pair of upper chord members disposed generally parallel to each other in a horizontal plane;

a lower chord member disposed beneath the upper chord members to form a triangular cross-section so that three vertices are formed by the upper chord members and the lower chord member;

a pre-tension member extending generally longitudinally within the triangular space;

whereby a compressive force is exerted on the lower chord member as tension is exerted on the pre-tension member.

14 Claims, 7 Drawing Sheets

TRUSSED GIRDER WITH PRE-TENSION MEMBER THEREIN

BACKGROUND OF THE INVENTION

1. Field of the Invention

The present invention relates to trusses used in large span constructions.

2. Prior Art

Among the many types of roof structures for large-span constructions are prestressed trussed girders, one type of which was invented by the present applicants (Japanese Publication Application No. 60-175997, as illustrated in FIG. 17). The trussed girder 51 comprises an upper chord member 57, a lower chord member 58 arranged generally parallel to the upper member 57, and lattice 59 for supporting and joining the upper chord member 57 and the lower chord member 58. In the trussed girder 51, a steel cable 62 is arranged along the lower chord member 58 (or the upper chord member 57) extending from one end of the lower chord member 58 (or the upper chord member 57) to another end of the lower chord member 58 (or the upper cord member 57) so as to exert a comprensive force on the lower chord member 58. By virtue of the trussed girder 51, large span contructions have become economically feasible, because of low weight and high rigidity of the structural members.

In the above conventional trussed girder 51, pre-tensed steel cables 62 are arranged along the upper chord members 57 or the lower chord members 58. It has been impossible, due to geometrical considerations, to arrange the steel cable 62 so that it will not cause a twisting force along the central axis of mass of the chord member in the case where the central axis of mass of the chord member is inside the chord member.

Furthermore, the out-of-plane strength is not sufficiently high in the above-mentioned trussed girder 51. If the span is larger than 50–60 m, it is difficult to first construct the whole structure on the ground and then move it into position by crane, because of low buckling resistance. Hitherto, it was necessary to construct the trussed girders in sections and then attach them one to the other in position by using temporary constructions, and the like.

A continuous bending moment does not act on the column in the trussed girder if a steel cable 62 is arranged along the lower chord member 58 (or the upper chord member 57) extending from a fixture at one end of the lower chord member 58 (or the upper chord member 57) to another fixture at the other end of the lower chord member 58 (or the upper chord member 57), as described above. Conversely, there is a large continuous bending moment acting on the foot of the column when the trussed girder 51 receives a wind load or a superimposed load. The base construction is therefore uneconomical.

SUMMARY OF THE INVENTION

It is an object of the invention to provide a trussed girder that can be constructed easily and economically and to solve the above-mentioned problems in prestressed trussed girders.

According to the invention, a trussed girder is provided to be positioned between a pair of columns, the trussed girder comprising:

a pair of upper chord members disposed generally parallel to each other in a horizontal plane;

a lower chord member disposed beneath the upper chord members to form a triangular cross-section so that three vertices are formed from the upper chord members and the lower chord member;

a pre-tension member extending generally longitudinally and within the triangular space;

whereby a comprenssive force is exerted on the lower chord member as tension is exerted on the pre-tension member.

DETAILED DESCRIPTION OF THE INVENTION

Referring first to FIGS. 1 through 10, a trussed girder according to a first embodiment of the invention is explained.

Figure 1:
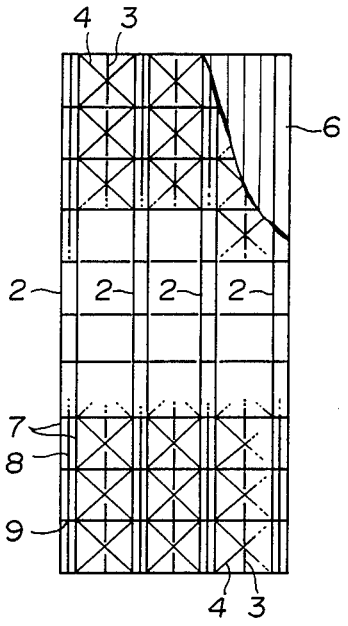
FIG. 1 is a partial plan view of a trussed girder according to the first embodiment of this invention.
Figure 2:
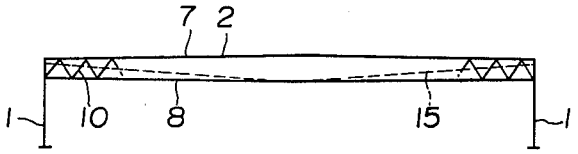
FIG. 2 is a side view of the trussed girder illustrated in FIG. 1.
Figure 3:
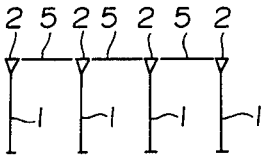
FIG. 3 is an elevation view of the trussed girder illustrated in FIG. 1.

FIG. 1 is a partial plan view of a trussed girder according to a first embodiment of this invention. FIG. 2 is a side view of the construction illustrated in FIG. 1. FIG. 3 is an elevation view of the construction illustrated in FIG. 1. In the figures, a pair of columns 1 support a trussed girder 2 at both ends. The rods 3 and braces 4 brace upper chord members of the trussed girders 2. Braces 5 intersect the trussed girder 2 at right angles.

Figure 4:
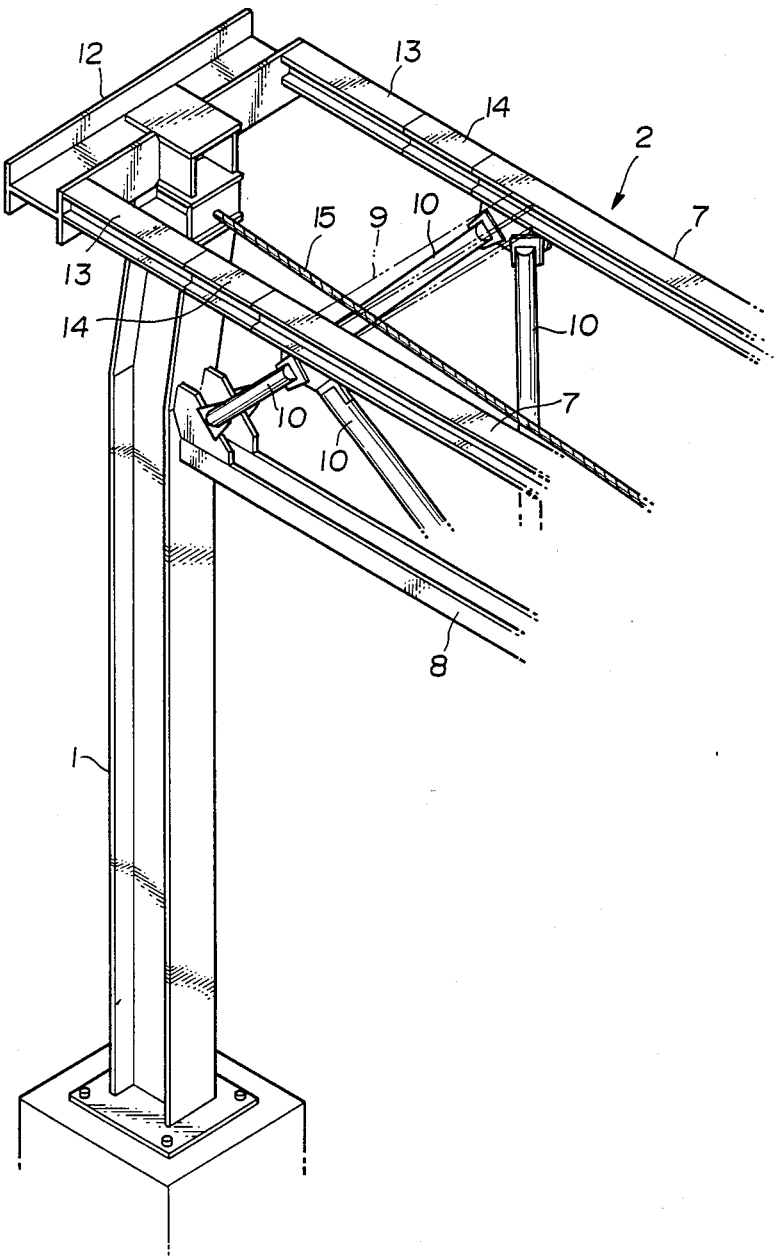
FIG. 4 is an enlarged perspective view of a joint of trussed girders and columns.
Figure 5:
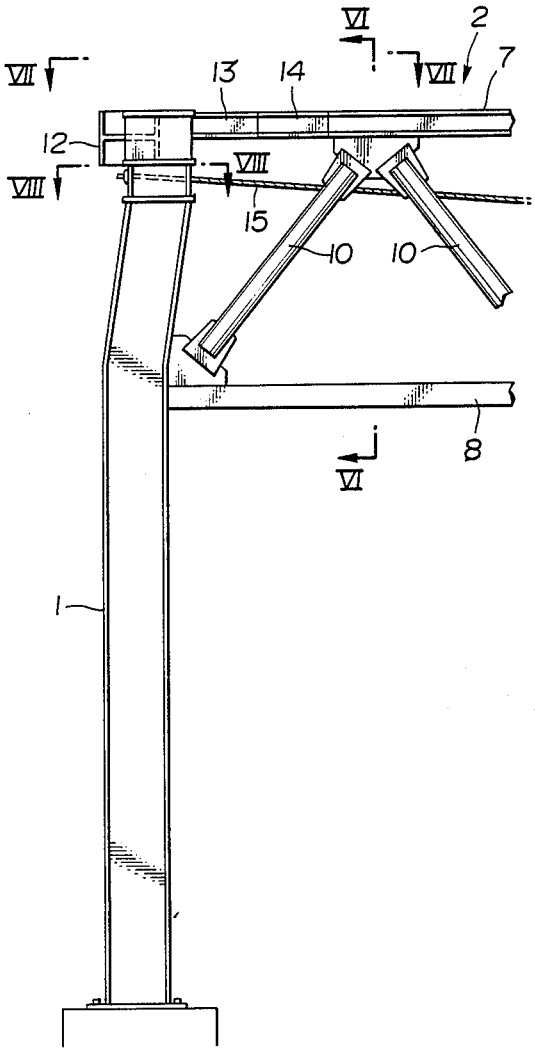
FIG. 5 is a side view of the joint illustrated in FIG. 4.
Figure 6:
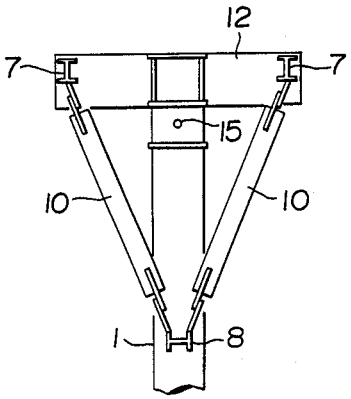
FIG. 6 is a side view taken along the line VI—VI in FIG. 5.

The trussed girder 2 comprises a pair of upper chord members 7 and a lower chord member 8 as illustrated in FIGS. 4 through 7. Tha pair of upper chord members 7 are braced and joined by tie rods 9. The upper chord members 7 are connected to the lower chord member by struts 10. In the figures, steel members of H-shaped cross section are used in the upper chord members 7, the lower chord member 8, the tie rods 9, and steel pipes are used in the struts 10. Steel cables of different cross-sectional shapes can be used for the upper chord members 7, the lower chord member 8, and the tie rods 9. For columns 1, tie rods 3, braces 4, and braces 5, not only H-shaped steel members but also other steel members can be used. Furthermore, the top of column 1 bends inward slightly as illustrated in FIG. 4. But the columns may also be straight.

In the trussed girder 2 as described above, the ends of the lower chord member 8 are fixed to columns 1 directly and rigidly. Each end of the upper chord members 7 is rigidly fixed to a bracket 12 which is connected to the upper end of the column 1 at a center thereof. The bracket 12 is fixed to the braces 5. Between the bracket 12 and each of the upper chord members 7, a joint member 13 and a tie rod 14, fixed to the bracket 12, in that order, are interposed.

Figure 8:
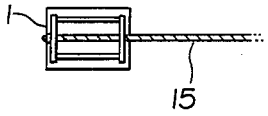
FIG. 8 is a cross section taken along the line VIII—VIII in FIG. 5.

Inside the trussed girder 2, is disposed steel cable 15. The steel cable 15 is arranged extending from a fixture at the upper end of a column 1 to another fixture at the upper end part of the other column 1, as illustrated in FIG. 8. The steel cable 15 is connected, at the central part thereof, to the lower chord member 7.

Figure 7:
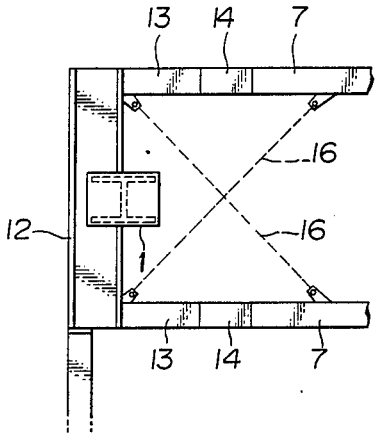
FIG. 7 is a top plan view taken along the line VII—VII in FIG. 5.

In order to construct the trussed girder 2 between the pair of columns 1, the bracket 12 is first to the upper end of the column 1 and a pair of joint members 13 are fixed to both ends of the bracket 12, and then, the pairs of columns 1 are set in place. The braces 5 span the distance between the brackets 12. The trussed girder 2 constructed on the ground is then positioned between the pair of columns 1. One end of the lower chord member 8 is rigidly fixed to a column 1 and another end is rigidly fixed to the other column, and each end of the upper chord member 7 is connected to the bracket 12 temporarily by horizontal braces 16 as illustrated in FIG. 7. After this, one end of steel cable 15 is fixed to the upper part of a column 1, and the other end of the steel cable 15 is fixed to the upper part of another column and steel cable 15 is pre-tensed. The tie rod 14 is interposed between each end of the upper chord members 7 and joint members 13, fixed to bracket 12, and then they are rigidly fixed to each other. After constructing the trussed girders 2 on the pairs of columns 1, the adjacent pairs of upper chord members 7 are connected to each other by tie rods 3 and braces 4, and then, roof plates 6 are placed thereon.

The above-mentioned trussed girder 2 comprising the pair of upper chord members 7 and the lower chord member 8 connected to the upper chord members 7 by struts 10, has a triangular cross-section so that the three vertices are formed from the upper chord members and the lower chord member. In contrast to the prior art (in which the steel cables to be pre-tensed are arranged along the upper chord members or the lower chord members), the steel cable 15 can be arranged "inside" the trussed girder 2. Therefore, the construction can be accomplished easily by virtue of the trussed girder 2.

Furthermore, the trussed girder 2 as described above has a three-dimensional inner volume in contrast to the plane trussed girder (prior art). The out-of-plane strength acting on the trussed girder 2 is superior to that acting on the plane trussed girder. In cases in which the span is larger than 50–60 m, it is easy to construct the entire structure on the ground and move the trussed girder into position by crane. In contrast to the prior art, the support members such as the buckling-stops and the horizontal braces are not needed, and the execution of construction using these trussed girders is simpler than that of the prior art by virtue of the plane trussed girders.

Figure 9:
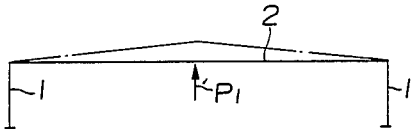
FIG. 9 is a schematic view showing thrust force and the moment acting on a trussed girder.

The upper thrust force $P_1$ acts on the pre-stressed trussed girder 2, as illustrated in FIG. 9, because the trussed girder 2 is prestressed by means of steel cable 15. The moment of the weight of the trussed girder 2 is decreased by the existence of the moment of the thrust force $P_1$ having the direction reversed to that of the weight of the trussed girder 2. As a result, tensile force is given to the pair of the upper chord members 7. Furthermore, compressive force is given to the lower chord member 8, and the shearing force acting on the struts 10 decreases $[0.5(P_1)]$. In addition, the compressive force is added to the lower chord member 8 from the column 1. Therefore smaller cross-sections for the upper chord members 7, the lower chord member 8, and the struts 10 may be used.

Figure 10:
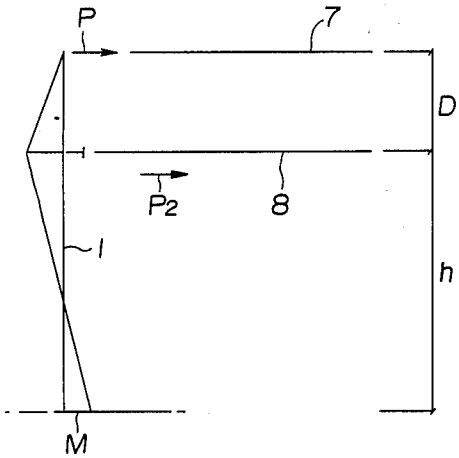
FIG. 10 is a schematic view showing the moment acting on a column.

The compressive force acting on the lower chord member 8 is larger than that in the case of steel cords being arranged along the lower chord member and being pre-tensed (the prior art). As shown in FIG. 10, the compressive force ($P_2$) acting on the lower chord member 8 is calculated by the formula:

$$P_2 = P + (3PD/2h)$$

wherein P represents the pre-stress acting on the upper part of column 1 applied by the tensile force from steel cord 15; D is the length from the lower end to the upper end of the trussed girder; h is the length from ground level to the lower end of the trussed girder constructed. The compressive force acting on lower chord member 8, $P_2$, is larger than the prestress acting on the upper part of column 1. Therefore, in the case in which the compressive force acting on the lower chord member 8 is constant, prestress P can be decreased.

Furthermore, in the case described above, a continuous bending moment acts on column 1 as shown in FIG. 10 and another bending moment M acts on the foot of column 1. The bending moment M is represented by a formula:

$$M = PD/2$$

The generated moment acting on the foot of column 1 upwind is canceled when column 1 receives a wind load. In the case that the wind moment is an extremely important consideration in construction, the construction of the base can be simplified. Downwind, the moement acting on column 1 is small. This moment acting on the column downwind is not important because it is much smaller than the moment acting on the column upwind.

FIGS. 9 through 12 show a trussed girder according to a second embodiment of the invention.

In these figures, labels for components and parts like or similar to those of the previous embodiment are omitted from the illustrations. The main differences between the trussed girder according to the second embodiment and that of the the first embodiment, are in the form of the column supporting the ends of the trussed girder 2, and in the arrangement for the steel cable 15.

Figure 12:
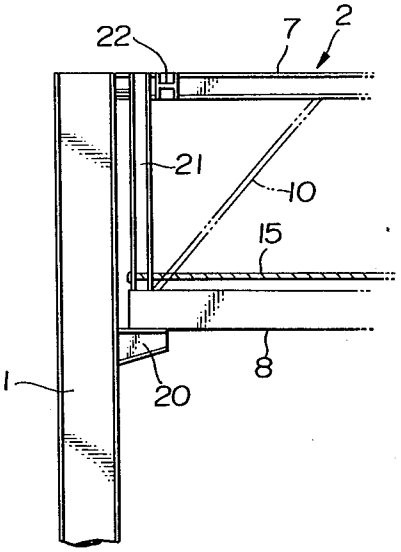
FIG. 12 is a side view of the joint illustrated in FIG. 11.
Figure 11:
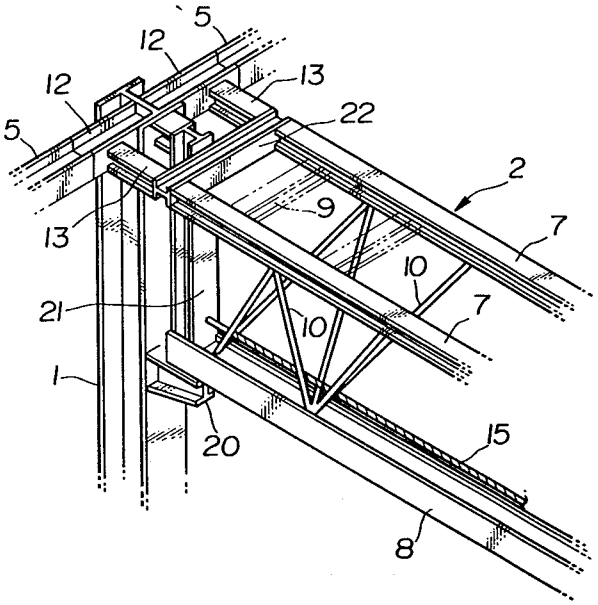
FIG. 11 is a perspective view of a joint of a trussed girder and a column according to the second embodiment of this invention.
Figure 13:
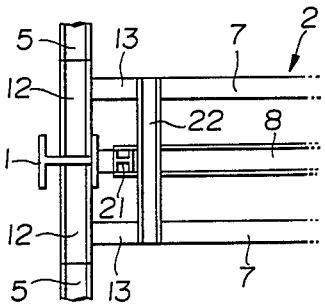
FIG. 13 is a plan view of the joint illustrated in FIG. 11.

As illustrated in FIGS. 11 through 13, the end of the lower chord member 8 of the trussed girder 2 is supported by a bracket 20 which is fixed to the column 1 by roller bearings. The lower end of a connecting member 21 is fixed to the upper end of the lower chord member 8, and the upper part of the connecting member 21 is rigidly fixed to the upper end of column 1. The end of the brace 5 is connected to an end of bracket 12, and another end of the bracket 12 is fixed to the column 1. The upper end of column 1 is interposed between the pair of brackets 12. Upper chord member 7 is fixed to column 1 by interposition of joint member 13 and bracket 12, as in the first embodiment. Each end of steel cable 15 is fixed to connecting member 21. Tie member 22 is joined between the pair of upper chord members 7.

Figure 14:
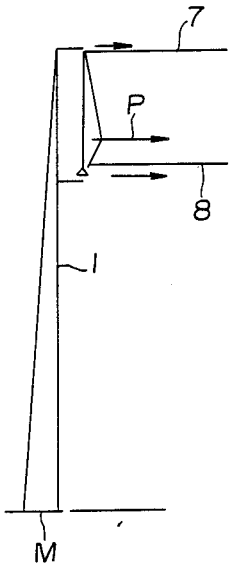
FIG. 14 is a schematic view of the moment acting on a column.

In this construction, the steel cable 15 is arranged inside the trussed girder 2 extending from a fixture at a connecting member 21 to a fixture at the other connecting member 21 and steel cable 15 is pre-tensed. The pair of upper chord members 7 bear very little tensile force, as in the first embodiment. As shown in FIG. 14, the great majority of the prestress P acts on the lower chord member 8, and the remainder of the prestress P acts on the pair of upper chord members 7. As a result, a compressive force acts on the lower member 8, and the cross section of the lower chord member 8 may be decreased.

Furthermore, in the second embodiment, the continuous moment acting on column 1 is shown in FIG. 14. The direction of the moment M acting on the foot of column 1 is reversed so as to be as in the first embodiment shown in FIG. 10. When the column 1 receives a wind load, the generated moment acting on the foot of column 1 upwind is not canceled. In contrast, the generated moment acting on the foot of column 1 by snow load and superimposed load can be canceled. If the snow load or the superimposed load is one of the most important considerations in construction, the base can be simplified.

In the second embodiment, the steel cable 15 is fixed to the connecting member 21 whose end is rigidly fixed to the column 1. The steel cable 15 may be fixed to the column 1 directly.

Figure 15:
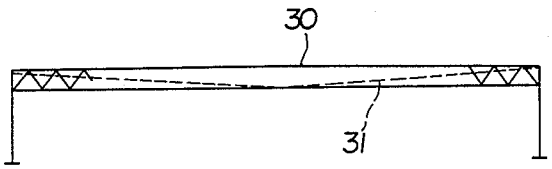
FIG. 15 is a side view of a plane trussed girder (comprising an upper chord member and a lower chord member) having a pre-tension member.
Figure 16:
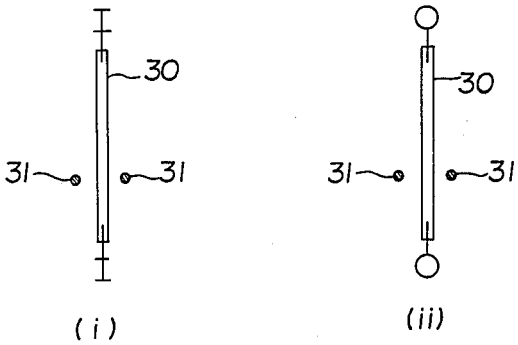
FIG. 16 is a cross-sectional view of the plane trussed girder, (i): in the case of using an H-shaped steel beam as a chord member, and (ii): in the case of using a steel pipe as a chord member.
Figure 17:
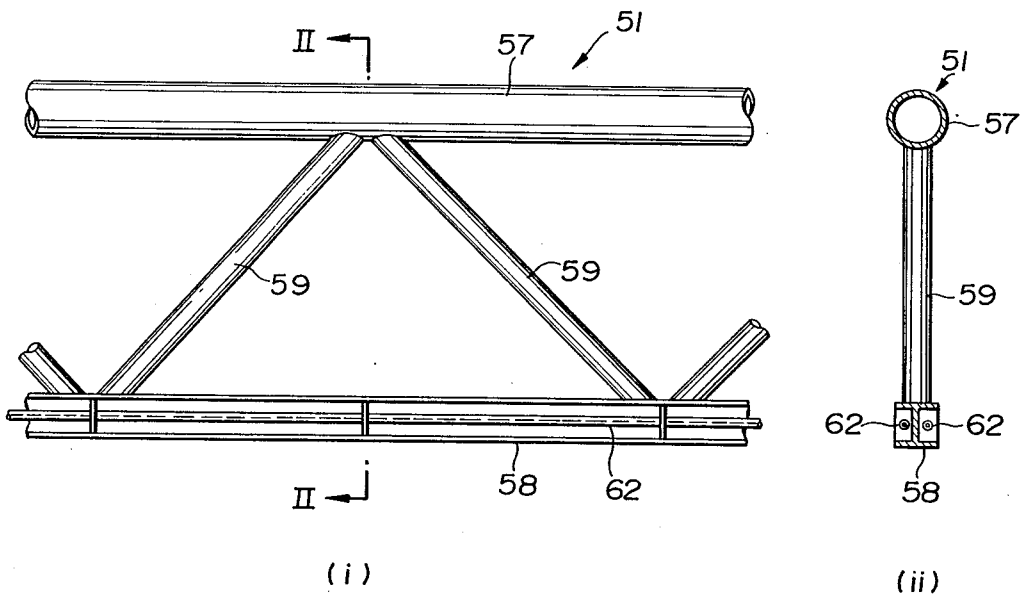
FIG.17 (PRIOR ART)
FIG. 17 (i) is a plan view of a trussed girder according to the prior art, and FIG. 17 (ii) is a cross section taken along the line II—II in FIG. 17 (i).

In the case of a plane trussed girder 30 which is prestressed by the use of a pair of steel cables 31, as shown in FIGS. 15 and 16, benefits such as decreasing the cross section of the chord members and simplifying the base construction can be realized, but the benefits are small. As described above, the extra-plane strength cannot be sufficiently maintained in the plane trussed girder. Furthermore, it is difficult to arrange the pair of steel cables 31 on both sides of the plane trussed girder 30 to maintain a balance. Therefore, it is recommended that the steel cable is arranged and pre-tensed inside the trussed girder comprising the lower chord member and the pair of upper chord members.

What is claimed is:

1. A trussed girder to be positioned between a pair of columns, the trussed comprising:

a pair of upper chord members;

a lower chord member disposed below the upper chord members so as to form a space of triangular cross-section between the pair of upper chord members and the lower chord members, three vertices of the space of triangular cross-section being formed by the pair of upper chord members and the lower chord member; and a pre-tension member extending longitudinally within the space of triangular cross section, both ends of the pre-tension member being fixed to corresponding columns, whereby a compressive force is exerted on the lower chord member as tension is exerted on the pre-tension member.

2. A trussed girder according to claim 1, wherein the pre-tension member is passing through an axis of symmetry including the lower chord member of the triangular cross-section.

3. A trussed girder according to claim 1, wherein the trussed girder further comprising a pair of connecting members attached to respective ends of the upper cord members and lower chord member, whereby both ends of the pretension member are fixed at respective connecting members.

4. A trussed girder according to claim 1, wherein ends of the pre-tension member are attached to corresponding upper portions of the columns and the pre-tension member is attached to the lower chord member at a central portion thereof.

5. A trussed girder according to claim 1, wherein ends of the pre-tension member are attached to corresponding lower portions of the columns and the pre-tension member is attached to the lower cord member at a central portion thereof.

6. A trussed girder according to claim 1, wherein tha pair of upper chord members are disposed parallel to each other in a horizontal plane.

7. A method for construction a trussed girder between a pair of columns, the method comprising the steps of:

(a) fixing both ends if each of two upper chord members to respective columns so that the upper chord members extend between the columns;

(b) fixing both ends of a lower chord member to respective columns so that the lower chord member extends horizontally between the columns below the upper chord members so as to form a space of triangular cross-section between the pair of upper chord members and the lower chord member, three vertices of the space of triangular cross-section being formed by the upper chord members and the lower chord member;

(c) extending a pre-tension member between the columns and within the the space of triangular cross section;

(d) exerting tensile force on the pre-tension member, whereby compressive force is exerted on the lower chord member; and (e) fixing both ends of the pre-tension member to corresponding columns.

8. A method for constructing a trussed girder between a pair of columns according to claim 6, wherein a central portion of the pre-tension member is attached to the lower chord member and both ends of the pre-tension member are attached to corresponding columns at an elevation greater than the lower chord member.

9. A method for constructing a trussed girder between a pair of columns according to claim 7, wherein the pre-tension member is passing through an axis of symmetry including the lower chord member of the triangular cross-section.

10. A method for construction a trussed girder between a pair of columns according to claim 7, wherein the upper chord members extend parallel to each other in a horizontal plane.

11. A method for constructing a trussed girder between a pair of columns, the method comprising the steps of:

(a) fixing both ends of each of two upper chord members to respective connecting members so that the upper chord members extend parallel to each other;

(b) fixing both ends of a lower chord member to respective connecting members so that the lower chord member extends therebetween so as to form a space of triangular cross-section between the pair of upper chord members and the lower chord member, three vertices of the space of triangular cross-section being formed by the upper chord members and the lower chord member;

(c) extending a pre-tension member between the connecting members in the space of triangular cross-section;

(d) exerting tensile force on the pre-tension member so that compressive force is exerted on the lower chord member to complete a trussed girder; and (e) setting the trussed girder completed in above step (d) between the columns.

12. A method for constructing a trussed girder between a pair of columns according to claim 11, wherein a central portion of the pre-tension member is attached to the lower chord member and both ends of the pre-tension member are attached to corresponding connecting members at an elevation greater than the lower chord member.

13. A method for constructing a trussed girder between a pair of columns according to claim 11, wherein both ends of the pre-tension member are attached to corresponding connecting members to extend horizontally in a space of triangular cross-section.

14. A method for constructing a trussed girder between a pair of columns according to claim 11, wherein the pre-tension member is passing through an axis of symmetry including the lower chord member of the triangular cross-section.

* * * * *